US007316330B2

(12) United States Patent
Müller et al.

(10) Patent No.: US 7,316,330 B2
(45) Date of Patent: Jan. 8, 2008

(54) DISPENSING SYSTEM FOR FLUID SUBSTANCES

(75) Inventors: Barbara Müller, Langenau (DE); Werner Mannschedel, Langenau (DE)

(73) Assignee: Coltene/Whaledent GmbH & Co., KG, Langenau (DE)

( * ) Notice: Subject to any disclaimer, the term of this patent is extended or adjusted under 35 U.S.C. 154(b) by 8 days.

(21) Appl. No.: 10/521,347

(22) PCT Filed: Apr. 17, 2003

(86) PCT No.: PCT/EP03/04092

§ 371 (c)(1),
(2), (4) Date: Jan. 13, 2005

(87) PCT Pub. No.: WO2004/009249

PCT Pub. Date: Jan. 29, 2004

(65) Prior Publication Data

US 2005/0230422 A1 Oct. 20, 2005

(30) Foreign Application Priority Data

Jul. 19, 2002 (DE) ..... 102 33 051

(51) Int. Cl.
*B67D 5/60* (2006.01)

(52) U.S. Cl. ..... 222/145.6

(58) Field of Classification Search ..... 222/137, 222/145.6

See application file for complete search history.

(56) References Cited

U.S. PATENT DOCUMENTS 4,974,756 A * 12/1990 Pearson et al. ..... 222/137
6,161,730 A * 12/2000 Heusser et al. ..... 222/137
6,394,314 B1 5/2002 Sawhney et al.
6,843,652 B2 * 1/2005 Xie et al. ..... 433/90

FOREIGN PATENT DOCUMENTS

EP 0 408 331 A 1/1991
EP 0 993 864 A 4/2000

* cited by examiner

*Primary Examiner*—Philippe Derakshani
(74) *Attorney, Agent, or Firm*—Fay Sharpe LLP; Karl W. Hauber

(57) ABSTRACT

The invention relates to a delivery system for fluid substances, which comprises a plunger-type syringe in the form of a cartridge having at least one injectate chamber, which injectate chamber is provided with an injection plunger, and an attachment mounted on the cartridge at its delivery-side end, characterised in that the attachment is mounted on the cartridge by means of a releasable snap closure.

10 Claims, 3 Drawing Sheets

DISPENSING SYSTEM FOR FLUID SUBSTANCES

Figure 1:
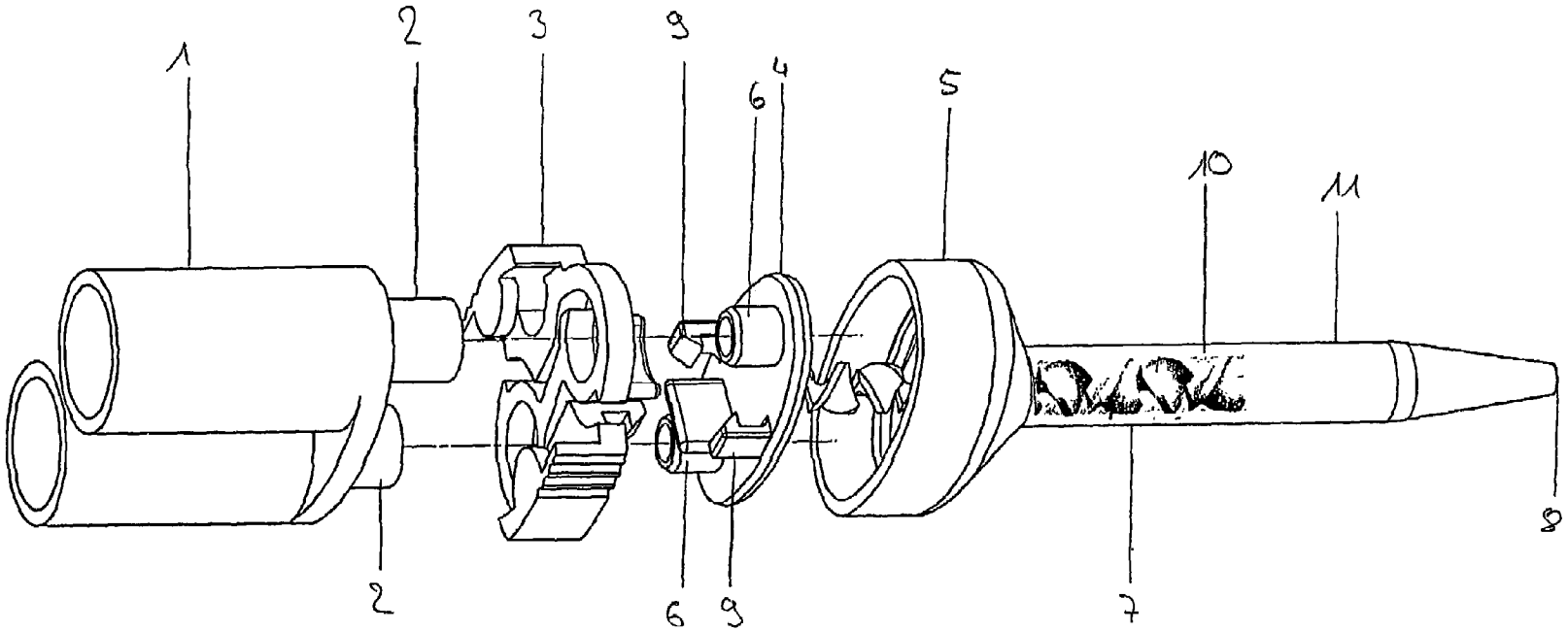

The present invention relates to a delivery system for fluid substances. It relates especially to a delivery system comprising a plunger-type syringe in the form of a cartridge having at least one injectate chamber provided with an injection plunger, and an attachment mounted on the cartridge at its delivery-side end.

Such delivery systems are already known in the prior art. For example, a double-barrel plunger-type syringe is used, which comprises a cartridge composed of two axially parallel, adjacently arranged injectate chambers with injection plungers guided therein, on which a mixer tip is mounted. The mixer tip has hitherto been mounted by simply being pushed on or by means of a screw connection (Luer lock closure) for which the plunger-type syringe is provided with an internal or external thread in which the mixer tip, which is provided with a complementary thread, engages.

The solutions known in the prior art for mounting attachments on the plunger-type syringe are, however, associated with considerable disadvantages. For example, when highly viscous fluids are being used, push-on connections do not provide a secure connection because they generally do not withstand the higher plunger pressure that is necessary in such a case. Although that problem does not arise in the case of Luer lock closures, there is a risk, especially in the case of highly viscous fluids, that contamination will occur when the attachment is mounted and removed as a result of smearing of outlet openings of the cartridge.

The aim of the present invention is to overcome the disadvantages of the solutions for mounting an attachment on a plunger-type syringe known in the prior art. That aim is achieved according to the invention by the features of the independent claim. Advantageous configurations of the invention are given in the subsidiary claims.

According to the invention there is provided a delivery system for fluid substances which comprise a plunger-type syringe and an attachment mounted thereon. The plunger-type syringe comprises a cartridge having at least one fluid chamber which is provided with an injection plunger. When the cartridge has a plurality of fluid chambers, injection plungers can be pushed into or withdrawn from the fluid chambers either separately or together, the injection plungers in the latter case advantageously being joined to one another by a suitable connecting element. A locking clip, on which the attachment is mounted by a releasable snap closure, is arranged between the cartridge and the attachment.

A characteristic feature of the invention provides that the attachment is mounted on the cartridge by means of the releasable snap closure. The releasable snap closure can, in principle, have any desired configuration, provided it is ensured that when the snap closure is locked into place a protuberance of any desire nature locks into a groove of any desired nature by resilient-plastic deformation of the cartridge and/or the attachment. For example, the snap closure can take the form of a sliding sleeve mounted on the attachment and having an internal annular collar which is pushed over an outer annular collar mounted on the outer side of the cartridge. The locking into place of the snap closure is preferably accompanied by an audible clicking sound, so that the locking-in can be monitored acoustically by the user.

In an embodiment of the invention that is preferred according to the invention there are formed on the attachment, for the purpose of its being mounted on the cartridge by means of a snap closure, two hooks which lie substantially diametrically opposite one another. The hooks each engage in undercut grooves which are arranged facing the hooks, each groove being arranged on a resilient arm which is formed at the locking clip and which is resiliently biased on being deflected out of its rest position. In order that the hooks are able to enter into engagement with the undercut grooves it is first necessary to overcome the resilient spring force of the resilient arms. When the hooks are in engagement with the undercut grooves, the resilient spring force of the resilient arms in the same way ensures that the hooks are secured against release.

The resilient arms are especially in the form of portions of the locking clip mounted on the delivery-side end of the cartridge, it being possible for the cartridge and the locking clip to be manufactured separately and then joined together. Conventional cartridges can thus advantageously be provided with the locking clip carrying the resilient arms for the snap closure, so that even already manufactured cartridges can subsequently be provided with a snap closure.

In an advantageous, very simple embodiment of the locking clip, the latter takes the form of (incomplete) rings which engage around the outlet openings of the cartridge, the rings being joined to one another by at least one rib-like element. In such a case the resilient arms having the undercut grooves project symmetrically from the rings so that on rotation of the cartridge through 180° about its longitudinal axis they can take each other's places.

Furthermore, for the resilient deflection of the resilient arms the resilient arms can be provided with pressure faces in the form of planar widened portions. When a sufficient pressing force is exerted on the pressure faces, the hooks and the undercut grooves are displaced relative to one another, the resilient arms being deflected, so that the hooks become disengaged from the undercut grooves and the snap closure can be released. The pressure faces advantageously lie substantially diametrically opposite one another, so that the snap closure can be released in an especially simple and practical way by simultaneous pressure on the pressure faces, for example by a user simultaneously pressing the pressure faces together with thumb and index finger.

In an especially advantageous embodiment, the attachment is so configured that it has no rotational symmetry in respect of axes of rotation in the longitudinal axis of the cartridge. For example, the attachment can in this respect have an oval or triangular cross-sectional surface. As a result, the attachment, especially when a plurality of injectate chambers is present, can be mounted on the cartridge in a specific ("correct") way, that is to say with the injectate chambers specifically assigned to an internal structure of the attachment. The possibility of "incorrect" mounting of attachments, as is the case with Luer lock closures in the prior art which are necessarily rotationally symmetrical, can thus be avoided.

The attachment according to the invention can be a mixer tip which receives the injectate from the injectate chambers which has been expelled under pressure through the outlet openings by the injection plungers and delivers it again in mixed form. Alternatively, the attachment according to the invention can be a closure cap for closing the outlet openings of the injectate chambers. The ease of mounting and removing the closure cap facilitated by the snap closure according to the invention provides a practical way of storing filled cartridges (or, as the case may be, cartridges that have already been used and are still partly full) at a certain location, for example in a refrigerator, and then using them again, without any risk of contamination.

Figure 2:
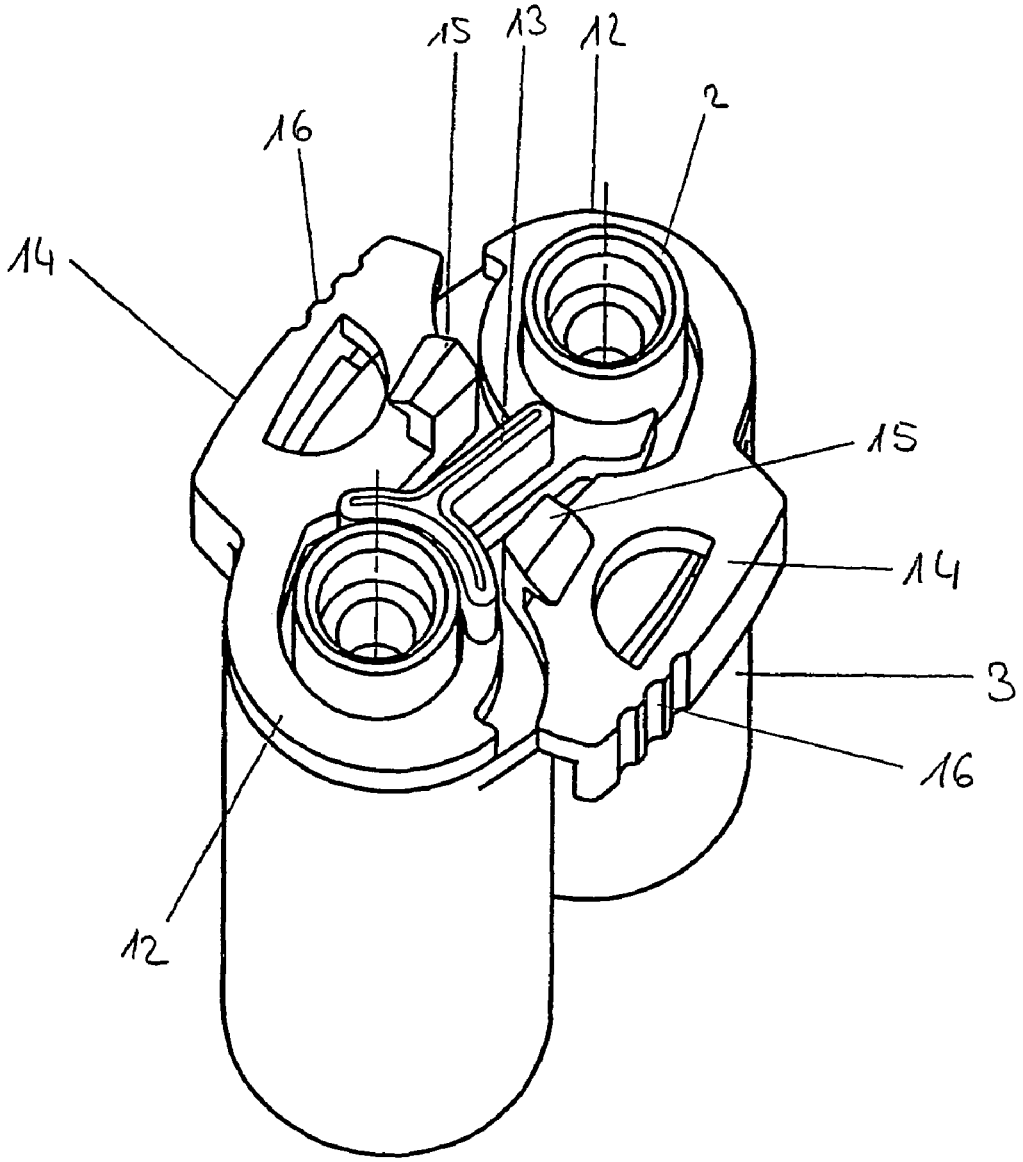
Figure 3:
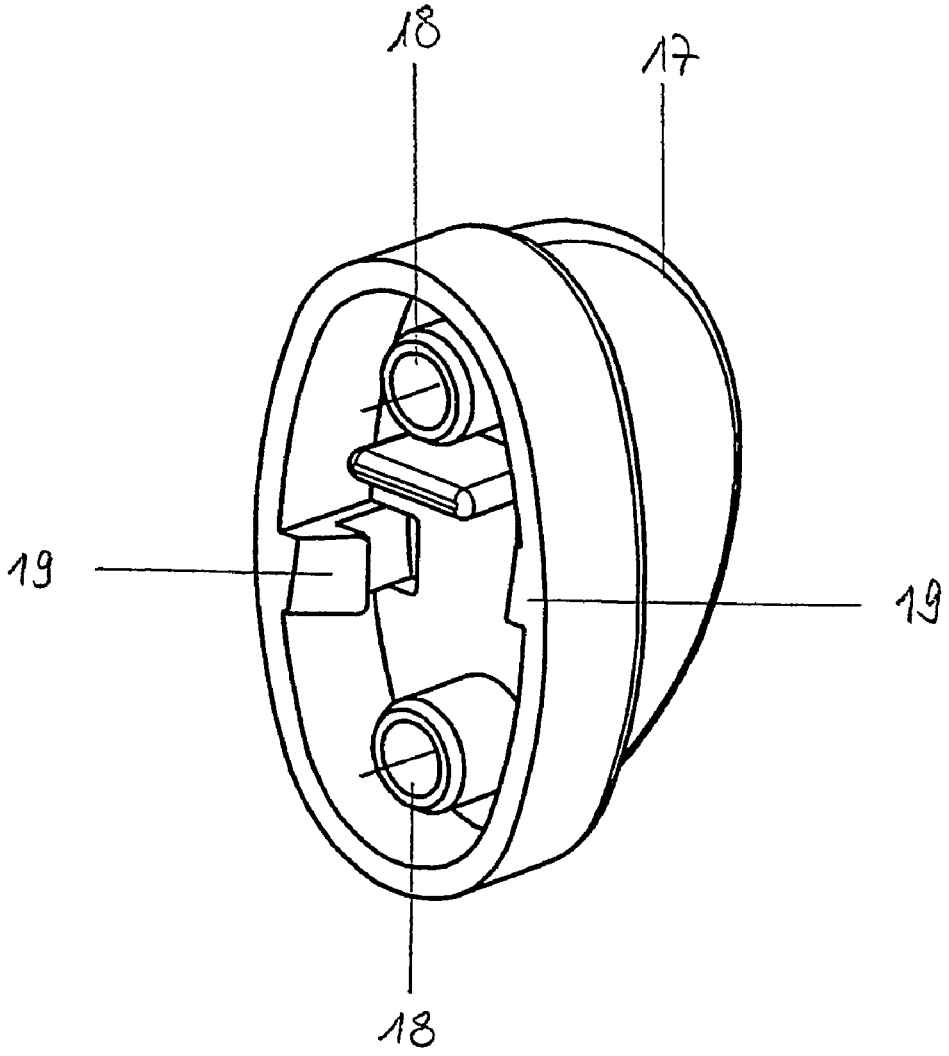

The invention will now be described in greater detail with reference to an example embodiment and referring to the accompanying drawings, wherein FIG. 1 is an exploded view of a delivery system according to the invention, FIG. 2 is a plan view, on an enlarged scale, of the locking clip of FIG. 1, and FIG. 3 is a perspective view of a closure cap.

Reference is made firstly to FIG. 1, which shows an exploded view of an embodiment of the delivery system according to the invention. Reference numeral 1 indicates the cartridge of a double-barrel piston-type syringe. The cartridge is provided with two injectate chambers each of which opens into an outlet opening 2. Reference numeral 3 indicates a locking clip which is provided with resilient arms on which the undercut grooves are arranged as part of the snap closure mechanism. The locking clip 3 is pushed onto the cartridge, especially onto its outlet openings 2. FIG. 1 also shows a mixer tip which is in turn composed of a distributor unit 4 and a mixer/delivery unit 5. The distributor unit 4 is provided with inlet openings 6 which, on assembly of the arrangement, extend into the outlet openings 2 of the cartridge and receive the injectate, which is expelled through the outlet openings 2 by introduction of the injection plungers into the injectate chambers. The mixer/delivery unit 5 has, located inside the delivery tip 11, a spiral 10 which provides for thorough mixing of the injectate. The delivery tip 11 is provided with an opening 8 for delivery of the injectate. On the distributor unit 4 there are arranged, diametrically opposite one another, two hooks 9 which, on assembly of the arrangement, enter into engagement with the undercut grooves of the resilient arms of the locking clip 3.

FIG. 2 shows a plan view, on an enlarged scale, of the locking clip 3 of FIG. 1 in a position in which it has been pushed onto the outlet openings 2 of the cartridge 1. The locking clip 3 engages around the outlet openings 2 of the cartridge 1 by means of incomplete rings 12, the incomplete rings 12 being joined to one another by a rib-like connecting element 13. The resilient arms 14 project from the incomplete rings 12, each resilient arm 14 projecting in the direction towards the other incomplete ring. The resilient arms 14 can take each other's places by rotation of the cartridge 1 through 180° about its longitudinal axis. The resilient arms are resiliently biased along the directions indicated by the arrows. On the resilient arms 14 there are arranged the undercut grooves 15 in which the hooks 9 of the mixer tip engage when the arrangement is in the assembled state. In order that the hooks 9 are able to engage in the undercut grooves 15, the resilient arms must be resiliently deflected in a direction towards one another. In the engaged state, the resilient spring force of the resilient arms ensures that the snap connection is secure. The resilient arms 14 are furthermore provided with pressure faces 16 arranged diametrically opposite one another, by means of which, with sufficient pressure perpendicular to the axial direction of the cartridge, deflection of the resilient arms is effected, so that when the pressure faces are actuated simultaneously the hooks 9 become disengaged from the undercut grooves 15 and the snap closure can be released.

FIG. 3 finally shows a closure cap 17 for the cartridge. The closure cap 17 is provided with blind sleeves 18 which, on being joined to the cartridge 1, close the outlet openings 2 of the injectate chambers. The closure cap 17 also has, arranged diametrically opposite, hooks 19 which, on attachment of the closure cap to the cartridge, enter into engagement with the undercut grooves 15 of the resilient arms 14 of the locking clip 3.

The invention claimed is:

1. Delivery system for fluid substances, which comprises a plunger-type syringe in the form of a cartridge having at least one fluid chamber, which fluid chamber is provided with an injection plunger, and an attachment mounted on the cartridge at its delivery-side end and a locking clip which is arranged between a cartridge and the attachment and, locked with the cartridge, wherein the attachment is mounted on the locking clip by means of a releasable snap closure;

the cartridge having at least two axially parallel, adjacently arranged fluid chambers having separate outlet openings;

the locking clip including incomplete rings joined to one another by at least one rib-like element therebetween;

each incomplete ring engaging around a separate outlet opening; and, the locking clip including resilient arms projecting from the incomplete rings wherein each resilient arm of one incomplete ring projecting in the direction towards the other incomplete ring.

2. Delivery system according to claim 1, wherein there are formed on the attachment, for the purpose of its being mounted on the cartridge, two hooks which are arranged substantially diametrically opposite; and the two resilient arms are resiliently biased on being deflected out of their rest position, each of which is provided with an undercut groove arranged facing a hook, the hooks engaging in the undercut grooves facing them.

3. Delivery system according to claim 1, wherein the resilient arms are in the form of portions of the locking clip mounted on the delivery-side end of the cartridge.

4. Delivery system according to claim 1 wherein the attachment is a closure cap for closing the outlet openings of the fluid chambers.

5. Delivery system according to claim 1 wherein the attachment has no rotational symmetry about axes of rotation in the longitudinal direction of the cartridge.

6. Delivery system according to claim 1 wherein the snap closure locks into place with an audible sound.

7. Delivery system for fluid substances, which comprises a plunger-type syringe in the form of a cartridge having at least one fluid chamber, which fluid chamber is provided with an injection plunger;

a locking clip selectively mountable on the cartridge at its delivery-side end;

an attachment selectively mountable on the locking clip by means of a releasable snap closure wherein the attachment including two hooks which are arranged substantially diametrically opposite for the purpose of its being mounted on the locking clip;

the locking clip including two resilient arms which are resiliently biased on being deflected out of their rest position, each of which is provided with an undercut groove arranged facing one of the two hooks, the hooks engaging in the undercut grooves facing them; and, wherein the resilient deflection of the resilient arms includes providing the resilient arms with pressure faces in the form of planar widened portions, the hooks becoming disengaged from the undercut grooves by exertion of a sufficient pressing force on the pressure faces.

8. Delivery system for fluid substances, which comprises a plunger-type syringe in the form of a cartridge having at least one fluid chamber, which fluid chamber is provided with an injection plunger, and an attachment mounted on the cartridge at its delivery-side end and a locking clip which is arranged between a cartridge and the attachment and, locked with the cartridge, wherein the attachment is mounted on the locking clip by means of a releasable snap closure;

wherein there are formed on the attachment, for the purpose of its being mounted on the cartridge, two hooks which are arranged substantially diametrically opposite; and there are formed on the delivery-side end of the cartridge two resilient arms which are resiliently biased on being deflected out of their rest position, each of which is provided with an undercut groove arranged facing a hook, the hooks engaging in the undercut grooves facing them;

the resilient arms are in the form of portions of a locking clip mounted on the delivery-side end of the cartridge; and, wherein the locking clip takes the form of incomplete rings which engage around the outlet openings of the cartridge and are joined to one another by at least one rib-like element, having resilient arms which project from the incomplete rings, which resilient arms can take each other's places by rotation of the cartridge through 180° about its longitudinal axis.

9. Delivery system for fluid substances, which comprises a plunger-type syringe in the form of a cartridge having at least one fluid chamber, which fluid chamber is provided with an injection plunger, and an attachment mounted on the cartridge at its delivery-side end and a locking clip which is arranged between a cartridge and the attachment and, locked with the cartridge, wherein the attachment is mounted on the locking clip by means of a releasable snap closure;

wherein there are formed on the attachment, for the purpose of its being mounted on the cartridge, two hooks which are arranged substantially diametrically opposite; and there are formed on the delivery-side end of the cartridge two resilient arms which are resiliently biased on being deflected out of their rest position, each of which is provided with an undercut groove arranged facing a hook, the hooks engaging in the undercut grooves facing them; and, wherein the resilient deflection of the resilient arms includes providing the resilient arms with pressure faces in the form of planar widened portions, the hooks becoming disengaged from the undercut grooves by exertion of a sufficient pressing force on the pressure faces.

10. Delivery system according into claim 9, wherein the pressure faces lie substantially diametrically opposite one another.

* * * * *